US006888268B1

(12) United States Patent
Stallings

(10) Patent No.: US 6,888,268 B1
(45) Date of Patent: May 3, 2005

(54) ENERGY STORAGE DEVICE

(75) Inventor: Charles H. Stallings, Pleasanton, CA (US)

(73) Assignee: The Titan Corporation, San Diego, CA (US)

( * ) Notice: Subject to any disclaimer, the term of this patent is extended or adjusted under 35 U.S.C. 154(b) by 347 days.

(21) Appl. No.: 10/043,929

(22) Filed: Jan. 11, 2002

Related U.S. Application Data

(60) Provisional application No. 60/260,976, filed on Jan. 11, 2001.

(51) Int. Cl.[7] ..... H01H 35/00

(52) U.S. Cl. ..... 307/126; 307/112

(58) Field of Search ..... 307/102–106, 307/108–110, 112–113, 125–126; 336/186, 182

(56) References Cited

U.S. PATENT DOCUMENTS

| | | | | | |
|---|---|---|---|---|---|
| 3,700,913 | A | * | 10/1972 | Dahlinger et al. | 307/107 |
| 3,731,183 | A | * | 5/1973 | Johnson et al. | 323/237 |
| 4,612,455 | A | * | 9/1986 | Weiner et al. | 307/419 |
| 4,670,662 | A | * | 6/1987 | Goldstein et al. | 307/106 |
| 5,684,341 | A | * | 11/1997 | Steingroever | 307/16 |
| 5,979,412 | A | * | 11/1999 | Werner | 123/490 |
| 2002/0180276 | A1 | * | 12/2002 | Sakuma et al. | 307/126 |

OTHER PUBLICATIONS

Ford, R.D., et al., "Novel hybrid XRAM current multiplier", *IEEE Transactions on Magnetics,* vol. 29, 6th Symposium on Electromagnetic Launch Technology, Austin, TX, USA, Apr. 28–30, 1992, pp. 949–953.

Botcharov, Yu.N., et al., "The Transient Processes End Energy Balance In Inductive Energy Storage Including Ferromagnetic Opening Switch", *Proceedings of the 12th IEEE International Pulsed Power Conference*—Monterey, CA, USA, Jun. 27–30, 1999, IEEE, Piscataway, NJ, 1999, p. 1250.

Kanter, M., et al., "Repetitive Operation of an XRAM Circuit", *Proceedings of 9th International Pulsed Power Conference,* Albuquerque, NM, USA, Jun. 21–23, 1992, IEEE, Piscataway, NJ, USA 1993, p. 92.

* cited by examiner

*Primary Examiner*—Lincoln Donovan
(74) *Attorney, Agent, or Firm*—Wiggin and Dana LLP; Timothy J. Olson; Gregory S. Rosenblatt

(57) ABSTRACT

A device uses a single inductor or a series of inductors to initially store energy. A series of opening switches are placed in the circuit with approximately equal inductance between each of the switches. Conducting leads are attached on either side of each opening switch and attached to the load at the other end. Each lead may have a blocking device such as a spark gap or diode to keep current from flowing in the load circuit when the leads are connected to the load. When the switches are all opened approximately simultaneously, the current in the storage inductor is transferred to the load with a voltage characteristic of the load and/or the opening time of the switches.

15 Claims, 3 Drawing Sheets

ENERGY STORAGE DEVICE

CROSS-REFERENCE TO RELATED APPLICATION

This patent application claims priority of U.S. Provisional Patent Application Ser. No. 60/260,976 entitled "Energy Storage Device" that was filed on Jan. 11, 2001 and is incorporated by reference in its entirety herein.

BACKGROUND OF THE INVENTION (1) Field of the Invention

This invention relates to energy storage, and more particularly to magnetic energy storage.

(2) Description of the Related Art

Many potential applications of pulsed power require tens of megajoules of energy that can be discharged over times from a few microseconds to a second. For most of these applications to be realized as practical devices, the energy density of the entire device (storage, switching, and power conditioning) must be greater than ten megajoules/$m^3$ with a goal on the order of 100 megajoules/$m^3$.

While there have been great strides in the energy density of electrostatic energy storage (capacitors), the current state-of-the-art is still only a few megajoules/$m^3$ and it will require major breakthroughs in materials and capacitor design to reach even ten megajoules/$m^3$.

Magnetic energy storage can typically be three orders of magnitude higher energy density than electrostatic energy density. Magnetic energy storage is frequently not utilized as a basic power source because the stray magnetic fields sometimes interfere with electronic or conducting parts near the energy storage and opening switches that are needed to extract the energy usually waste a large fraction of the stored energy.

When the leads are connected in parallel the system resembles a so called XRAM circuit (Marx spelled backward, see, e.g.,: Ford, R. D.; Hudson, R. D.; Klug, R. T., "Novel hybrid XRM current multiplier". *IEEE Transactions on Magnetics*, vol. 29, 6$^{th}$ symposium on Electromagnetic Launch Technology, Austin, Tex., USA, 28–30 April 1992.) January 1993. p.949–53; Botcharov, Yu. N.; Efimov, I. P.; Krivosheev, S. I.; Shneerson, G. A. (Edited by: Stallings, C.; Kirbie, H.) "The transient processes end energy balance in inductive energy storage including ferromagnetic opening switch"., *Proceedings of the* 12$^{th}$ *IEEE International Pulsed Power Conference-Monterey, Calif., USA,* 27–30 *June* 1999. IEEE—Piscataway, N.J., USA 1999.p.1250; Kanter, M.; Cerny, R.; Shaked, N.; Kaplan, Z. (Edited by: Prestwich, K. R.; Baker, W. L.) Repetitive operation of an XRAM circuit." *Proceedings of* 9$^{th}$ *International Pulsed Power Conference, Albuquerque, N.Mex., USA,* 21–23 *June* 1993 IEEE—Piscataway, N.J., USA 1993. p.92).

BRIEF SUMMARY OF THE INVENTION

Various aspects of the invention involve producing and delivering power. In one aspect, an inductor is provided and charged with a current to store energy in a magnetic field of the inductor. A plurality of switches are then opened so as to electrically isolate a plurality of segments of the inductor and electrically discharge such segments in parallel.

In implementations of this one aspect, the inductor may comprise a core and at least one conductor wrapped a plurality of turns around the core. The plurality of switches each may comprise a switch inductor encircling the at least one conductor. The opening may comprise applying at least one electrical pulse to said switch inductors. The at least one electrical pulse may be a single pulse applied to said switch inductors in common.

Various aspects of the invention involve energy storage devices for delivering power to a load. In one aspect, a first conductor wrapped a plurality of turns and forms a plurality of inductor elements. A plurality of switches each comprise a ferromagnetic core encircling the first conductor and a second conductor wrapped a plurality of turns around the ferromagnetic core. A plurality of first leads are each on a first side of an associated one of the switches for coupling to a first pole of the load. A plurality of second leads are each on a second side of an associated one of the switches for coupling to a second pole of the load.

In implementations of this one aspect, there may at least three such switches and associated such first and second leads. There may be 4–50 such switches and associated such first and second leads. There may be at least one core element around which said first conductor is wrapped said plurality of turns. Energy stored in the device may advantageously be stored principally if not exclusively inductively and without substantial capacitive storage if any.

Various aspects of the invention involve methods for operating an opening switch device for increasing the impedance of a portion of a first conductor. A ferromagnetic core is provided encircling the conductor and overwrapped by a plurality of turns of a second conductor. A charging current is directed through the first conductor effective to at least partially saturate the ferromagnetic core. A trigger current is directed through the second conductor effective to drive the ferromagnetic core out of said at least partial saturation and thereby increase the impedance of a section of the first conductor encircled by the ferromagnetic core by a factor of at least ten.

BRIEF DESCRIPTION OF THE DRAWINGS

Like reference numbers and designations in the various drawings indicate like elements.

DETAILED DESCRIPTION

Figure 1:
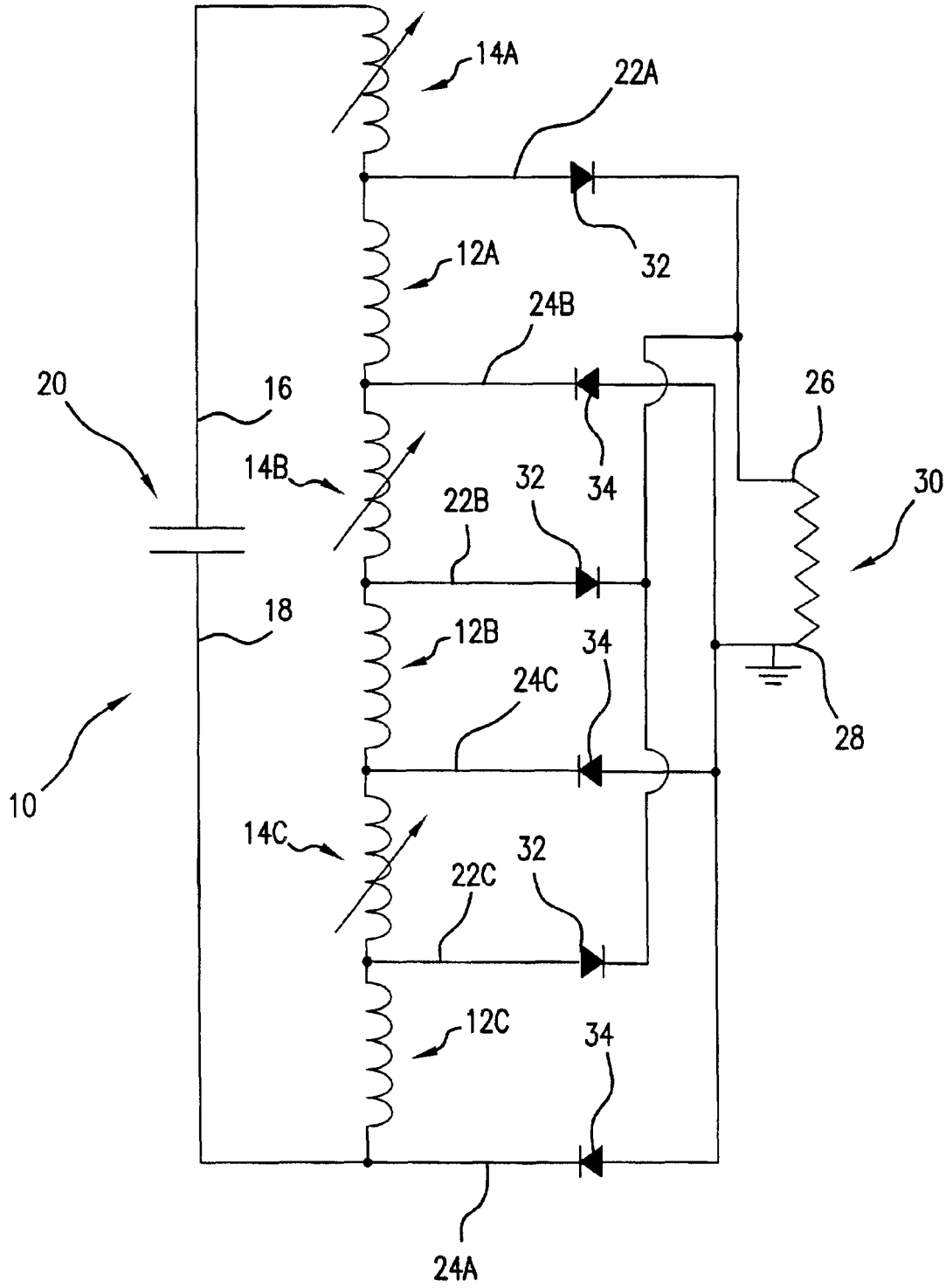
FIG. 1 is a schematic diagram of an exemplary three stage circuit.

FIG. 1 shows a system 10 in which an energy storage inductor has an exemplary three segments 12A–12C formed as the portions of an inductive coil conductor along three sectors of an inductor. Between respective segments is a corresponding magnetic opening switch 14A–14C. The inductive coil's circuit includes portions 16 and 18 coupling this series of segments to a power source 20 to provide power to the inductive circuit. On either side of each switch are a pair of positive and negative leads 22A–22C and 24A–24C, respectively. The positive and negative leads are respectively connected to positive and negative poles 26 and 28 of a pulsed power load 30. The positive and negative leads each contain a respective diode 32 and 34. The diodes (alternatively spark gaps or other devices may be used) prevent current from flowing to the load 30 while the coil is being charged and keep the load from shorting out the coil.

Figure 2:
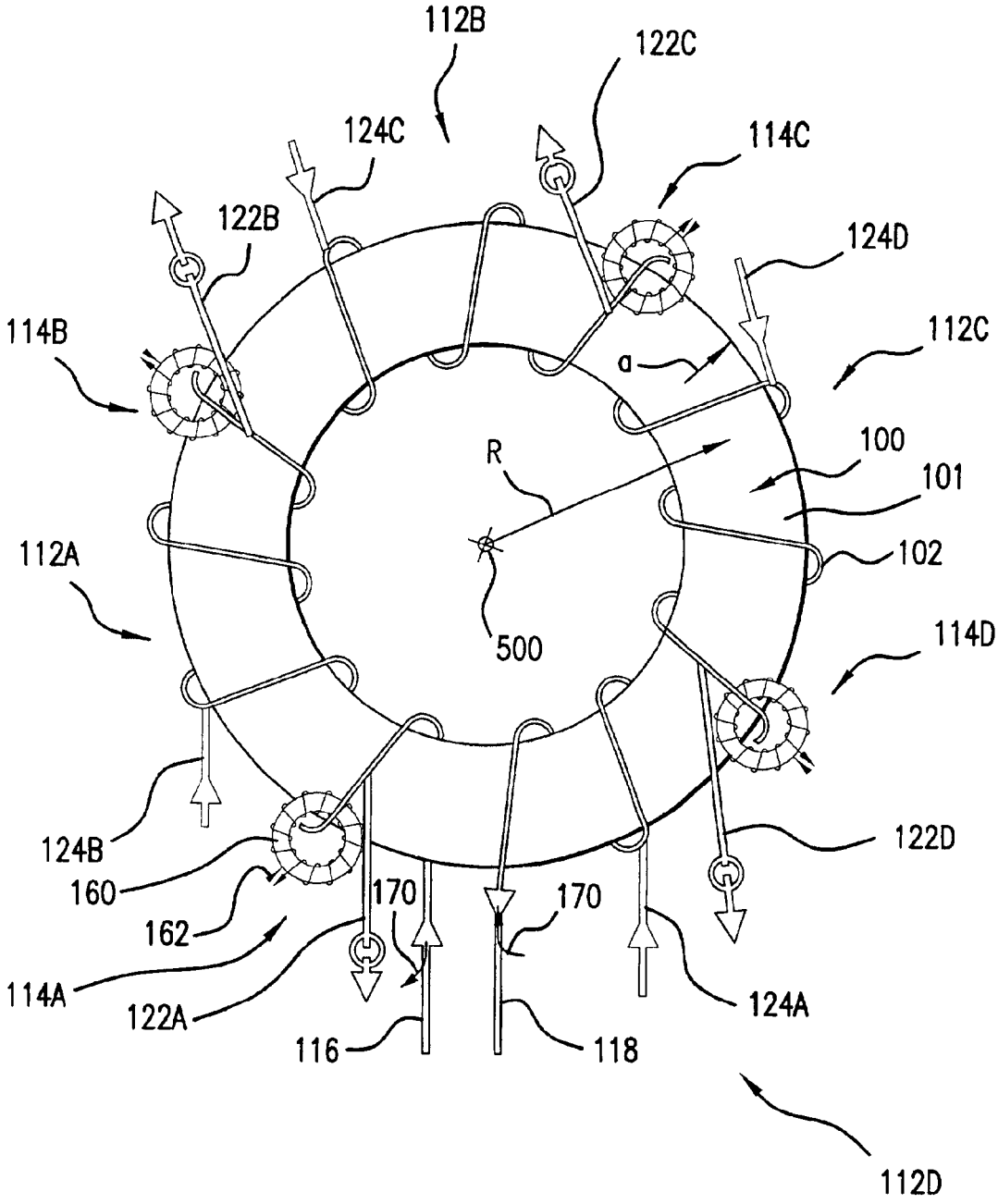
FIG. 2 is a semischematic view of a four stage energy storage coil.

The number of switches may be greater, even far greater than three. This number may be generally identified as Z. A preferred inductor is of toroidal form which helps minimize stray magnetic fields. An exemplary inductor includes one or more conductors wrapped around a toroidal core. In an exemplary system, the switches are substantially evenly spaced (every X turns) along the conductor which is wrapped turns around a core having a mean radius R and a cross-sectional radius a FIG. 2 shows further details of an alternate four-stage system wherein a storage inductor 100 includes a toroidal core 101 having a central longitudinal axis 500, a mean radius R and a cross sectional radius a. The storage inductor includes a conductor 102 wrapped around the core 101 and having terminal portions 116 and 118 coupled to a power source (not shown). For purposes of reference, components which may be similar to that of the embodiment of FIG. 1 are shown with similar reference numerals to which a leading hundreds digit has been added. In four locations along the conductor 102, there is a switch 114A–114D. Each exemplary switch 114A–114D may be formed as including a toroidal core 160 circumscribing the conductor 102. A conductor 162 is wound around the core 160 for carrying a switching current to/from a switching current source (not shown). The core 160 is saturated during charge and is driven unsaturated when a switching current trigger pulse is applied to the conductor 162. On either side of each switch, a pair of positive and negative leads 122A–122D and 124A–124D respectively, are coupled to the conductor 102. Between each positive lead associated with one switch and the negative lead associated with the next switch, there is an associated segment 112A–112D of the coil.

A good conductor 102 is a copper, silver, or superconducting wire. To enhance cooling, the conductor may be hollow, carrying a continuous flow 170 of a cooling fluid. An example of a cooling fluid is liquid nitrogen.

The foregoing storage coil of turns is charged with a current, I, in a time that is long compared to the required high power pulse. Typically the system can be charged in one to hundreds of seconds depending on the desired energy storage, discharge parameters, the resistance of the storage coil, and the parameters of the charging power supply. During an initial charging stage from an initial fully or partially discharged condition, each of the switches is closed so that current may flow between the inductor segments. The charging is accomplished by means of a direct current source such as a battery, capacitor, or AC to DC power supply.

To discharge the system, the switches are opened simultaneously (or close thereto) for example, the switches are converted into a high impedance substantially open state whereupon a potential across the various diodes, spark gaps, or other devices is sufficient to discharge the energy stored in each segment in parallel. On either side of each opening switch there is a lead that connects to a common pulsed power load. There are positive leads that are tied together and negative leads that are tied together.

A current of ZI is transferred to the pulsed power load. The minimum transfer time is defined by the inductance of closely coupled parallel inductors discharging into the impedance of the pulsed power load.

The energy storage system can utilize a number of triggered opening switches on a single inductor or a number of inductors, each with an opening switch, or some combination of the forgoing. The energy storage system can be used to multiply current (parallel connections), multiply voltage (series connections), or multiply both by a combination of series and parallel connections to the load.

With this concept the theoretical electromagnetic limits on energy density are very large, certainly greater than 100 $MJ/m^3$. However, resistive heating of the coil and the mechanical strength needed to confine the energy tend to impose practical constraints. Even with these limits, energy densities approaching 100 $MJ/m^3$ appear to be practical.

Advantageously, the opening switches are very simple and reliable, low inductance, non destructive, useable every few seconds, and require a simple low energy trigger. This may be distinguished from the more expensive use of complex semiconductor switch arrangements.

Figure 3:
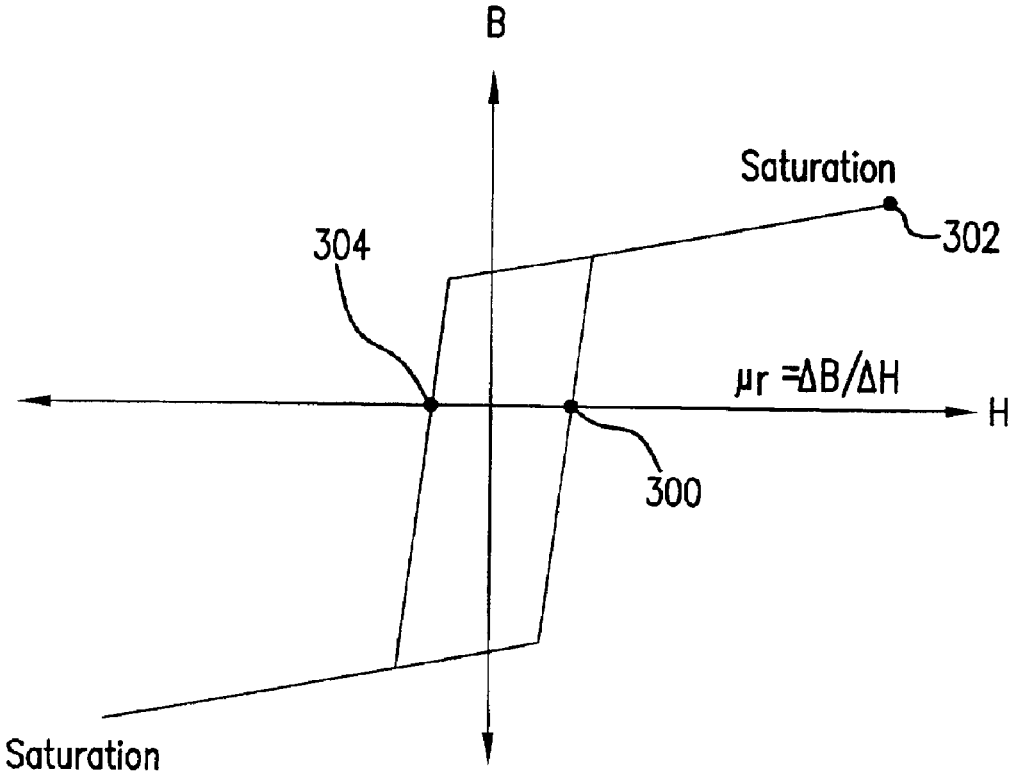
FIG. 3 is a graph of vs. for an exemplary magnetic switch.

For example, the opening switches can be comprised of a simple coil of wire (one or more turns) 162 (FIG. 2) wrapped around a toroidal core 160 of ferromagnetic material, encircling a single conductor of the storage inductor. The ends of the coil 162 around the core 160 are connected to the trigger systems (not shown). The storage inductor 100 is charged with current, thereby storing energy in the magnetic field which in turn saturates the trigger cores 160. Each core 160 is preferably designed so the ferrite is saturated (FIG. 3) when the storage inductor is charged from a discharged condition (point 300) to a filly charged condition (point 302). When the core 160 is saturated the relative permeability of the coil 162 is low. When the storage inductor 100 is fully charged and it is desired to extract the energy, a trigger signal is sent to the coils 162. This trigger signal must be of a size and duration to drive the coils 162 out of saturation, thereby increasing their relative permeability (e.g., to point 304). This increase in permeability increases the impedance of those portions of the storage coil 102 surrounded by the switch cores 160. The impedance of that portion of the storage coil 102 surrounded by the unsaturated switch core 160 should be higher than the impedance of the load. When this condition is satisfied, the current in the storage coil 102 will flow from the storage coil to the load instead of through the portion of the storage coil surrounded by the core 160. After discharge, the switch core state moves back toward saturation on the B-H curve (e.g., back toward point 302 after discharge).

When the total stored energy is constant but the number of turns (N) in the energy storage coil is changed, the final current in the load and the final switched inductance are constant if the number of turns between switches is maintained. If, however, the number of opening switches and current taps are kept constant and evenly spaced, when the total number of turns is changed, the driving inductance is proportional to $N^2$ and the current in the load is proportional to 1/N. The tradeoff for a system will be the original charge current and the required risetime in the load versus the number and complexity of opening switches and parallel feeds to the load.

EXAMPLE

An exemplary embodiment of this concept includes a toroidal inductor with an outer radius of 1.0 meter, an inner radius of 0.50 meters, with 200 turns on the toroid. This device would easily fit around a segment of an electric gun barrel and provide space efficient energy storage with short, easy coupling to the gun breach or barrel.

From *Inductance Calculations, Working formulas and Tables*, by Frederick W. Grover, 1973 Instrument Society of America ISBN: 08766451394, the inductance of a toroid, neglecting the small correction for space between turns is $$L\ (\text{henries}) = 1.257\times10^{-8} N^2 (R-(R^2-a^2)^{1/2})$$

where N is the number of turns, R is the mean radius of the toroid in centimeters and a is the radius of a circular cross section of the toroidal coil in centimeters.

For this example N=200, R=75 cm and a=25 cm. Therefore, $$L=2.16\times10^{-3} \text{ henries}$$

Since the energy stored in the inductor is $E=\frac{1}{2}L I^2$, a current of 30 kA in this coil will store one megajoule and a current of 96 kA will store ten megajoules. For constant stored energy the current can be decreased linearly with the number of turns. For example a 500-turn toroidal coil with the same dimensions only needs twelve kA for one megajoule stored and 38 kA for ten megajoules stored. For ten megajoules stored in this coil, this example corresponds to an energy density of eleven megajoules per cubic meter. With a current of 100 kA in a 500-turn coil, the stored energy would be 69 megajoules with and energy density of 76 megajoules/$m^3$.

The charging time for this energy storage device is dependent on the parameters of the charging power supply and the resistance of the energy storage coil. A superconducting storage coil can be charged very slowly while a normal storage coil needs to be charged relatively rapidly to minimize resistive losses and heating.

For the dimensions in this example the total length of all 200 turns in series is approximately 320 meters. To charge this energy storage coil with a 50 MW de power supply (100 kA and 500V, probably an electrolytic capacitor bank or high energy density batteries) the resistance of the full energy storage coil must be equal to or less than five milliohm. This implies a copper cross section of ten $cm^2$ and a weight of 3000 Kg. The charging time for this power supply and inductance is approximately one second.

The skin depth for copper is $\delta=(0.028\ m^2\ sec^{-1}/\omega)^{1/2}$ To ensure that the risetime of the electrical pulse is less than 100 microseconds, the cross section of the copper conductor must have at least one dimension that is less than 0.5 cm. This can be achieved either by using parallel conductors or by shaping the conductor.

The specific heat of copper is 0.092 cal/gm, and the average current is approximately one-half the peak current. Therefore, the conductor temperature will rise approximately 90° C. per charging cycle. With cooling fluid through the center of the conductor, this device can be operated repetitively with a frequency dependent on the final design of the system.

The energy density of eleven MJ/$m^3$ (in an exemplary system that stores ten MJ) is equivalent to a pressure of approximately 110 atmospheres or 1600 lbs/$in^2$ for approximately two seconds. This is within the range of current fabrication techniques.

There is a large improvement in efficiency and a very large decrease in the size of the power supply if the coil is superconducting. The actual design will be a tradeoff of efficiency versus the ancillary equipment needed to maintain a superconducting coil.

If the 200-turn coil has 33 opening switches with an opening switch in approximately every sixth turn, when the switches are opened, the system becomes 33 parallel, closely coupled inductors. When the switches are all opened simultaneously, energy and current are conserved, and the currents all operate in parallel to drive a single load. The net driving inductance in the 200-turn toroidal example will be $2.04\times10^{-6}$ henries and the current will be 990 kA for one megajoule stored and 3.1 MA for ten megajoules stored. For a 30 milli-ohm load, the L/R falltime (the limit to get energy out of the coil) for a 200-turn toroidal coil of these dimensions is 68 microseconds.

Energy can be stored magnetically in a storage coil with energy densities often MJ/$m^3$ to 100 MJ/$m^3$. By using saturated magnetic coils as switches every few turns on the main energy storage coil, the energy can be switched into a load in less than 100 microseconds with a current that is many times the original current that was used to charge the storage coil. The system can be triggered and operated for several shots with no degradation of performance and without replacing any components. By proper design of the energy storage coil, the device can be tailored in shape and energy density for the application and stray magnetic fields can be minimized. To obtain high efficiency and utilize a simple DC power supply, the coil must be very low resistance or a superconductor; however, it is possible to design a build a ten MJ device with normal copper conductors.

One or more embodiments of the present invention have been described. Nevertheless, it will be understood that various modifications may be made without departing from the spirit and scope of the invention. For example, the configuration (including inductor shape) as well as various materials may be adapted to any particular application. The storage core can be of magnetic material or nonmagnetic material or its place may be taken by air or vacuum. Multiple separate cores may be used, arranged in a loop (e.g., a square of four core segments), a line, or otherwise, with or without substantial mutual inductance. Different types of switches (including even mechanical switches) may be used depending upon load requirements. Additionally, multiple such systems may be connected coupled in series, in parallel, or both to magnify their individual performance. For example, it may be advantageous to power an electromagnetic gun at many points along the length of its barrel. This can be accomplished using several smaller energy storage devices. If the optimal impedance is different for different locations along the barrel, some of the energy storage devices may be wired in parallel to have a lower voltage and higher current while those further down the barrel may be wired to give higher voltage and lower current. Accordingly, other embodiments are within the scope of the following claims.

What is claimed is:

1. A method for producing pulsed power comprising:

closing at least two switches, said switches magnetically coupled to a first wire wrapped a plurality of turns around a toroid and said switches dividing said first wire into a plurality of first wire segments;

passing electrical current through said first wire thereby causing energy to be stored in a resultant magnetic field; and actuating simultaneously said switches to increase the impedance of the portions of said first wire segments adjacent to said switches causing a pulse of said stored energy to flow from each of said portions of said first wire segments.

2. The method of claim 1 wherein said pulse of energy flows through an energy blocking device to a load.

3. The method of claim 2 wherein said current blocking devices are selected from the group consisting of diodes and spark gaps.

4. The method of claim 3 wherein said at least two switches each comprise a plurality of turns of a second wire wrapped around a core of ferromagnetic material encircling said first wire and said actuation comprises applying an electrical trigger pulse to each second wire.

5. A method for producing power comprising:

providing an inductor;

charging said inductor with a current to store energy in a magnetic field of the inductor; and opening a plurality of switches so as to electrically isolate a plurality of segments of the inductor and electrically discharge such segments in parallel.

6. The method of claim 5 wherein the inductor comprises a core and at least one conductor wrapped a plurality of turns around the core and wherein said plurality of switches each themselves comprise a switch inductor encircling the at least one conductor and wherein said opening comprises applying at least one electrical pulse to said switch inductors.

7. The method of claim 6 wherein said at least one electrical pulse is a single pulse applied to said switch inductors in common.

8. A method for operating an opening switch device for increasing the impedance of a portion of a first conductor comprising:

providing a ferromagnetic core encircling the first conductor overwrapped by a plurality of turns of a second conductor;

directing a charging current through the first conductor effective to at least partially saturate the ferromagnetic core; and directing a trigger current through the second conductor effective to drive the ferromagnetic core out of said at least partial saturation and thereby increase the impedance of a section of the first conductor encircled by the ferromagnetic core by a factor of at least ten.

9. The method of claim 8, wherein the first conductor is wrapped around a second ferromagnetic core.

10. A method for producing pulsed power comprising:

passing electrical current through a conductor forming a winding of at least one inductor, the conductor being disposed through a plurality of ferromagnetic cores;

increasing permeability of each of the ferromagnetic cores relative to the conductor to increase impedance in sections of the conductor proximate the ferromagnetic cores; and diverting electric current in portions of the conductor between the sections of the conductor to a load after increasing the impedance in the sections of the conductor.

11. The method of claim 10, wherein the impedance in each section of the conductor exceeds the impedance of the load.

12. The method of claim 10, wherein permeability of each of the ferromagnetic cores relative to the conductor is increased in response to an electrical signal provided in a second conductor disposed through the second core.

13. The method of claim 12, wherein the ferromagnetic cores are driven out of a state of at least partial saturation in response to the electrical signal.

14. The method of claim 10, wherein the at least one inductor comprises:

a plurality of inductors electrically connected in series, the conductor forming the winding of each inductor in the plurality of inductors.

15. The method of claim 10, wherein the at least one inductor comprises:

an inductor core, the conductor being wound around the inductor core.

* * * * *